United States Patent [19]

Grün

[11] 4,002,323

[45] Jan. 11, 1977

[54] ARRANGEMENT FOR MIXING AND TREATING POWDERED AND GRANULAR MATERIAL

[75] Inventor: Gustav Grün, Ortenberg, Lissberg, Germany

[73] Assignee: Luco-Technic Ag., Zurich, Switzerland

[22] Filed: Aug. 7, 1975

[21] Appl. No.: 602,744

[52] U.S. Cl. ..... 259/8; 259/DIG. 17

[51] Int. Cl.[2] ..... B01F 7/16; B01F 15/00

[58] Field of Search ..... 259/DIG. 17, 7, 8

[56] References Cited

UNITED STATES PATENTS

| | | | |
|---|---|---|---|
| 3,285,578 | 11/1966 | Edwards et al. | 259/8 |
| 3,333,827 | 8/1967 | Lodige et al. | 259/8 |

FOREIGN PATENTS OR APPLICATIONS

| | | | |
|---|---|---|---|
| 900,242 | 7/1962 | United Kingdom | 259/DIG. 17 |

*Primary Examiner*—Robert I. Smith

[57] ABSTRACT

An arrangement for mixing and treating powdered and granular material by introducing compressed gas into a mechanically driven mixing device with an upright cylindrical mixing tank. The tank has an intake for the material to be mixed, and an outlet for the mixed material. Above the flat bottom of the tank, is a rotating hub to which stirring paddles are fastened. A vacant space is left between the flat bottom of the tank and the wall panels of the stirring paddle, and extends from the hub to the cylindrical outside wall of the tank. Supply channels introduce the compressed gas through the hub and into the vacant space. A slit is provided between the hub and the wall panels of the stirring paddle and the adjacent tank wall section for the exit passage of compressed gas into the mixing tank along the entire stirring paddle from the hub to the outside cylindrical wall of the tank.

7 Claims, 5 Drawing Figures

ARRANGEMENT FOR MIXING AND TREATING POWDERED AND GRANULAR MATERIAL

BACKGROUND OF THE INVENTION

The present invention relates to an arrangement for mixing and treating powdered and granular material by means of compressed gas, and a mechanically driven mixing device with an upright cylindrical mixing tank. The tank has an intake for the material to be mixed, and an outlet for the mixed material, and a flat bottom.

There are already known in the art various mixing devices which produce the mixing effect through the introduction of compressed air into the mixing tank. The compressed air is introduced either through sintered bottoms or directed nozzles.

While, in mixers with sintered bottoms, the mixing is accomplished at pressures up to 10,000 mm of water column, for mixers with directed air nozzles much higher pressures—between 5 and 50 atmospheres gauge are necessary. Here air exit speeds beyond the speed of sound develop at the nozzle ends.

Mixers with sintered bottoms have the disadvantage that with different mixing materials, such as lead dust and soot, or different granulations, e.g., dustlike and granular products, perfect mixing cannot be achieved. It may even happen that the material is sorted out, so that the coarse components remain on the sintered bottom and the fine components escape upward. Another disadvantage is that the admitted air escapes by way of canals forming in the material so that the product not affected, balls up or coalesces and can no longer be mixed.

It is also already known in the art, to mix and homogenize dry powdery materials by introducing compressed air into a mixing tank through a sintered bottom and simultaneously keeping the material to be mixed in motion by mechanically-driven stirring paddles (German Disclosure No. 1,027,966). However, such a device can be used only for completely dry, finely powdered material.

In the case of mixers with directed air jets where the air is introduced at high speed, there may take place a grinding effect at the nozzle end so that the structure of the material is changed. The power required for generating the compressed air is very large and continual maintenance work on the equipment is unavoidable. The tank walls are subject to heavy wear. The filters used for the escape of the air are under a heavy load.

In addition, expensive equipment as, for example, compressors, tanks where the air is stored, and high-pressure lines are necessary.

It is, therefore, an object of the present invention to avoid the disadvantages of conventional mixing devices.

It is a particular object of the present invention to provide a device for mixing and treating powdered and granular material requiring minimum power, minimum wear, and minimum maintenance.

Another object of the present invention is to provide a mixing arrangement for powdered and granular material of the foregoing character, which has a long operating life and may be maintained in service economically.

A further object of the present invention is to provide an arrangement, as described, which is simple in design and construction and may be fabricated at substantially low cost.

SUMMARY OF THE INVENTION

The objects of the present invention are achieved by providing that directly above the flat bottom of the mixing tank, there is located a rotating hub. Attached to this hub is a stirring paddle of saddle-roof like cross-section in such a way that there is an empty space extending from the hub to the cylindrical outside wall of the mixing tank. Intake channels provide for introduction of compressed gas through the hub into this hollow space. Between the hub and the wall panels of the stirring panel and the adjacent tank wall sections, a slit is provided to facilitate the exit of compressed gas into the mixing tank along the entire stirring paddle from the hub to the cylindrical wall.

This preceding construction makes it possible that the filled-in material is fluidized only at those points where the stirring paddle or paddles are located at that particular time. If the stirring paddles are set in motion by a drive motor, the entire contents are particularly fluidized. Quick and intensive mixing takes place. Mixing is accomplished through the upward flow of the material on the front side of the stirring paddle and the drop into the empty space resulting behind the paddle. As a result, both heavy and light, fine and coarse-grained products, are mixed thoroughly without grading as may develop with sintered bottoms. The compressed gas exiting at the stirring paddles, e.g., air, produces an air cushion diectly on the surfaces of the paddles so that the rotary motion does not in any way damage the material to be mixed. The speed of the stirring paddles can be set according to tank size, and may be from 5 to 30 revolutions per minute.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
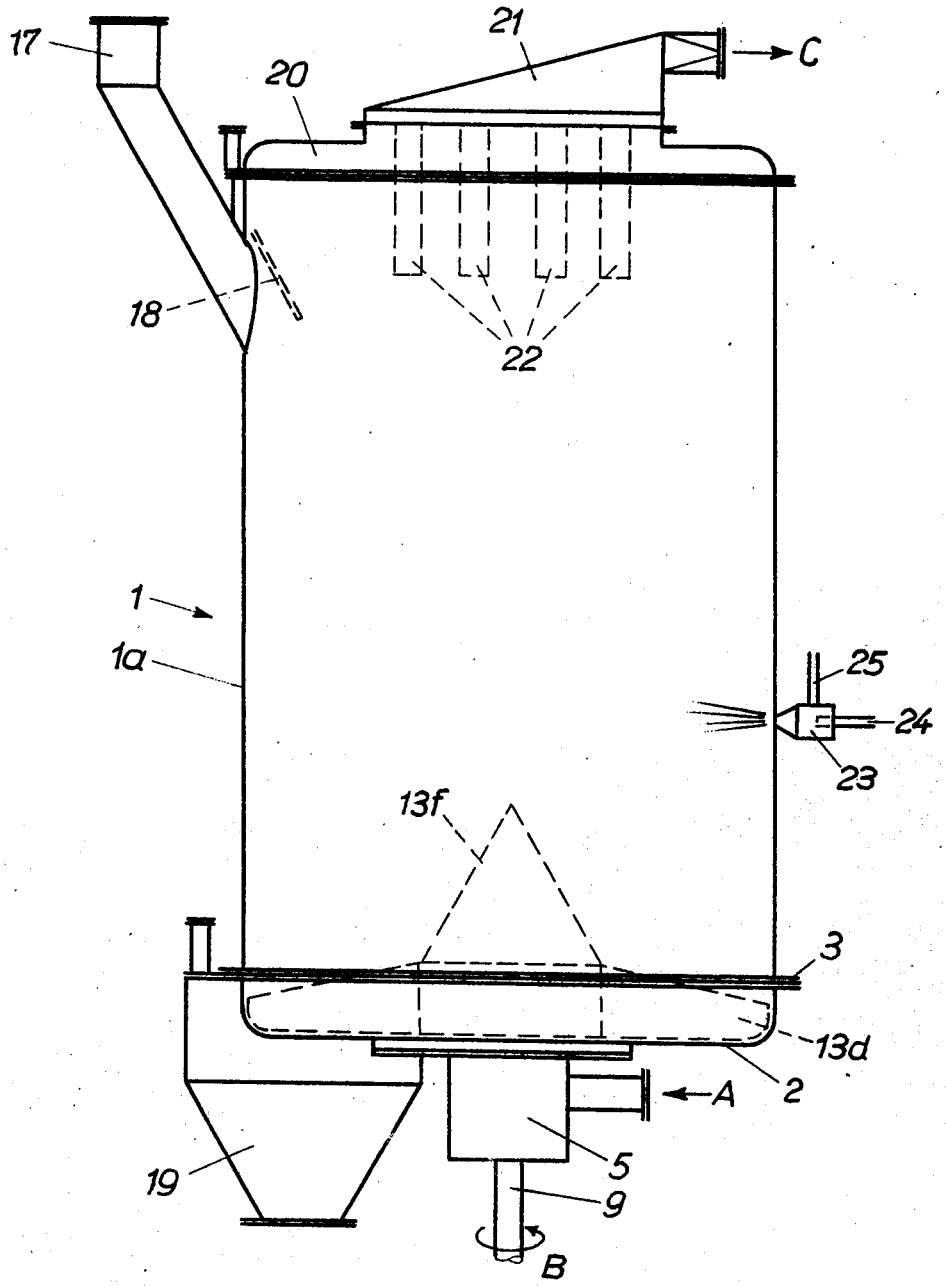
FIG. 1 is a schematic side view of the device in accordance with the present invention.
Figure 2:
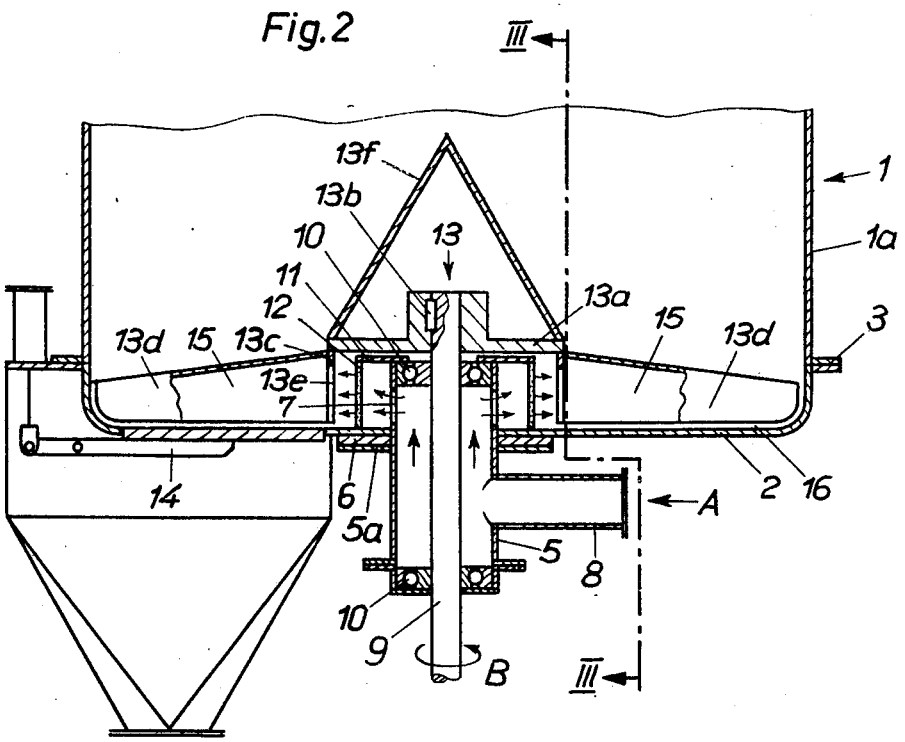
FIG. 2 shows an enlarged axial section of the bottom part of the device of FIG. 1.
Figure 3:
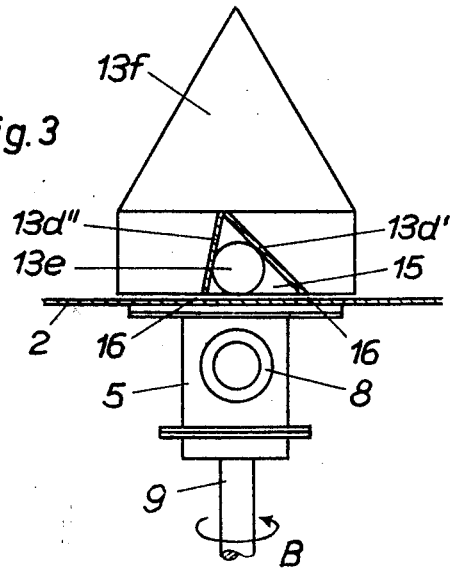
FIG. 3 is a sectional view taken along line III—III of FIG. 2.

The device shown in FIGS. 1 through 3 has a cylindrical mixing tank 1 terminated at the bottom by a flat bottom 2. Flat bottom 2 is screw-fastened to the tank wall 1*a* along flanges 3. The flat bottom 3 has a central opening in which a thick-walled pipe 5 is inserted and which is screw-fastened by means of flange 5*a* to a reinforcement flange 6 of flat bottom 2. That part of pipe 5 protruding into tank 1 has several transverse drill holes 7. To that part of pipe 5 protruding out of tank 1, there is welded a pipe section or stub 8 connected to a source of compressed air indicated by arrow A; this source generates a pressure of approximately 10,000 mm of water column.

Pipe 5 encloses a driveshaft 9 mounted rotatably in bearings 10. It is driven by an electric motor (not shown) in the direction of arrow B. A cover 11 is attached to the upper end of pipe 5. A cylindrical ring 12 made of porous sintered (powder) metal is clamped between this cover 11 and flat bottom 2.

By means of a key 13*b*, the mechanical mixing device 13 is rigidly connected to the upper part of shaft 9. The mixing device has a hub section and two stirring paddles 13*d*. The hub section has a hub flange 13*a* to whose bottom side a cylindrical bushing 13*c* is fastened. The bushing 13*c* carries the stirring paddles 13*d* consisting of two panels 13*d'* and 13*d''* making an oblique angle with one another (FIG. 3). Hence an empty space 15 exists between the two panels and the flat bottom. Bushing 13*c* has openings 13*e* between panels 13*d'* and 13*d'*. A slot 16 is located between the bottom edges of bushing 13*c*, stirring paddles 13*d* and wall sections 2 or 1*a* of tank 1. A conic hood 13*f* is located on top of the hub flange 13*a*.

On the top side of tank 1 there is a filler connection 17 for the material to be mixed; during operation of the device, this filler connection can be closed by a lid 18. The bottom side of tank 1 contains within an outlet funnel 19, a flap or lid 14 which may be actuated pneumatically. On top, the tank is closed with a cover 20 consisting of an insert 21 with known air filters 22.

In the bottom part of sidewall 1*a*, several two-component nozzles 23 may be distributed along the circumference. These nozzles are supplied with a liquid through line 25 and compressed air through line 24.

In operation of the device of the present invention, the material to be mixed is introduced into the tank 1 through filler connection 17. Thereafter compressed air (or other compressed gas) at a pressure up to 10,000 mm of water column is introduced through stub 8. It flows through pipe 5, openings 7, porous ring 12 and openings 13*e* into the empty space 15 between paddles 13*d*. The compressed air escapes along the entire length of paddles 13*d* through slits 16 and fluidizes the material to be mixed. Then the stirring or mixing paddles are set into motion so that the entire contents of the tanks are fluidized which accomplishes quick and intensive mixing.

Figure 4B:
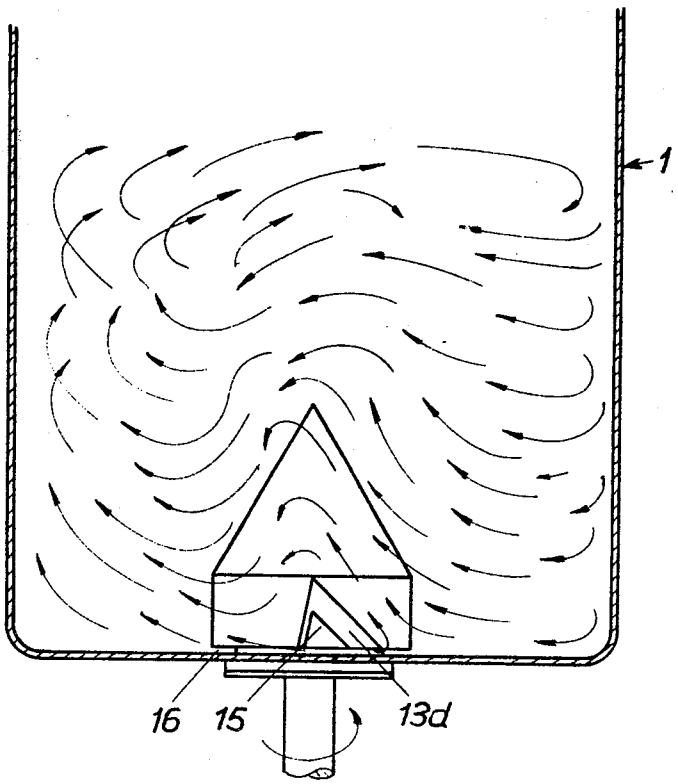
FIG. 4*a* and 4*b* are schematic views of the air flow in the mixing tank with stirring paddle positions at right angles.
Figure 4A:
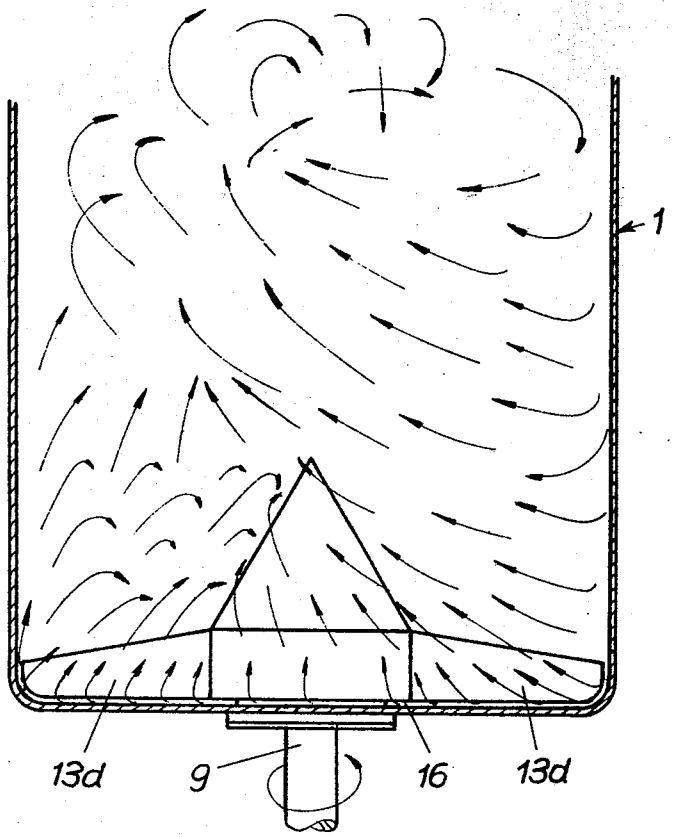

FIG. 4*a* and 4*b* show the flow conditions inside the mixing tank 1 during rotation of the stirring paddles 13*d* by means of arrows. Ahead of the stirring paddles, the fluidized material flows upward and drops down again at the rear side, with simultaneous intensive swirling motion or turbulence. The compressed air introduced into the tank 1 at A escapes through the filter 22 in cover 20, and through the insert 21 and into the exterior environment in the direction of arrow C.

In the embodiment shown, the forward part of the panel, 13*d'* makes a smaller angle with the flat bottom 2 than the rear part of the panel, 13*d''*. The stirring paddles, however, may also have a different saddle-roof-like design. Thus, they may form a dihedral triangle with the flat bottom 2, or the paddle panel may be semicircular in cross-section.

For specific purposes, aromatic materials may be added to washing agents, and liquids can be sprayed into the fluidized dry material through the two-component nozzles 13 by means of the compressed air. It is possible to attain completely uniform wetting with minimum liquid addition (0.1%).

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention, and therefore, such adaptations should and are intended to be comprehended within the meaning and range of equivalence of the following claims.

I claim:

1. Apparatus for mixing and treating powdered and granular material by means of compressed gas comprising, in combination, mechanically driven mixing means with an upright cylindrical mixing tank having an intake for the material to be mixed and an outlet for the mixed material, said tank having a flat bottom; rotating hub means directly above said flat bottom of said mixing tank; at least one stirring paddle with wall panels fastened to said hub and leaving a vacant space between said flat bottom of said tank and said wall panels of said stirring paddle, said vacant space extending from said hub means to the outside wall of said mixing tank; supply channel means for passing compressed gas through said hub means into said vacant space; slit means between said hub means and said wall panels of said stirring paddle and adjacent tank wall sections for the exit passage of compressed gas into said mixing tank along the entire stirring paddle from said hub means to said outside wall.

2. The apparatus as defined in claim 1 wherein said stirring paddle has a substantially saddle-roof shaped crosssection.

3. The apparatus as defined in claim 1 wherein said outside wall of said mixing tank has a substantially cylindrical shape.

4. The apparatus as defined in claim 1 including two-component nozzle means distributed in the lower region of said outside wall of said mixing tank, said outside wall having a substantially cylindrical shape, said nozzle means being distributed throughout the circumference of said wall for introducing liquid by means of compressed air.

5. The apparatus as defined in claim 1 including pipe means inserted in said flat bottom of said tank and coaxial with the axis of said tank; bearing means in said pipe means; drive shaft means for said mechanical mixing means and held in said bearings; connecting means on said pipe means on the outside of said mixing tank for introducing compressed air into said mixing tank, said pipe means having outlet opening means for said compressed air on the inside of said mixing tank.

6. The apparatus as defined in claim 5 including cylindrical ring means of porous sintered material and located coaxially with respect to said pipe means within said mixing tank, said cylindrical ring means being sealed from the opening of said pipe means and said flat bottom of said tank.

7. The apparatus as defined in claim 1 wherein said hub means comprises a hub flange; a cylindrical bushing fastened to said hub flange and carrying stirring paddles, said bushing having openings for the passage of compressed air into vacant spaces between said stirring paddles.

* * * * *